US006093221A

United States Patent [19]

Grüll et al.

[11] Patent Number: 6,093,221

[45] Date of Patent: Jul. 25, 2000

[54] PROCESS FOR REDUCING SULFUR AND VAT DYES

[75] Inventors: Dietmar R. Grüll, Langenschönbichl, Austria; Alireza Haji Begli, Ramsen, Germany; Nikolai Kubadinow, Vienna, Austria; Markwart Kunz, Worms; Mohammad Munir, Kindenheim, both of Germany

[73] Assignee: Sudzucker Aktiengesellschaft, Germany

[21] Appl. No.: 09/319,407

[22] PCT Filed: Nov. 22, 1997

[86] PCT No.: PCT/EP97/06544

§ 371 Date: Jul. 22, 1997

§ 102(e) Date: Jul. 22, 1997

[87] PCT Pub. No.: WO98/24967

PCT Pub. Date: Jun. 11, 1999

[30] Foreign Application Priority Data

Dec. 7, 1998 [DE] Germany ..... 196 50 825

[51] Int. Cl.[7] ..... D06P 1/30; D06P 1/22; C09B 7/00; C09B 67/28

[52] U.S. Cl. ..... 8/579; 8/650; 8/651; 8/652; 8/653; 8/607; 8/611

[58] Field of Search ..... 8/650, 653, 918, 8/676–79, 607, 611

[56] References Cited

U.S. PATENT DOCUMENTS

| | | |
|---|---|---|
| 5,030,248 | 7/1991 | Meszaros . |
| 5,470,356 | 11/1995 | Meszaros . |
| 5,632,782 | 5/1997 | Carlough . |

FOREIGN PATENT DOCUMENTS

| | | |
|---|---|---|
| 0699797 | 3/1996 | European Pat. Off. . |
| 3928068 | 3/1990 | Germany . |
| 2201165 | 8/1988 | United Kingdom . |
| 93/07221 | 4/1993 | WIPO . |

OTHER PUBLICATIONS

K. Poulakis, et al., "Einfluss von Ultraschall auf die Verküpungsgeschwindigkeit von Indigofarbstoffen mit α–Hydroxy–aceton als Reduktionsmittel", *Textilveredlung,* vol. 31, No. 5/6, 1996, pp. 110–113.

*Primary Examiner*—Margaret Einnsmann
*Attorney, Agent, or Firm*—Ostrolenk, Faber, Gerb & Soffen, LLP

[57] ABSTRACT

This invention concerns a process for reducing dyes of the group consisting of sulfur and vat dyes. The reduction is carried out in an aqueous alkali medium using isomaltulose or a mixture containing isomaltulose as the reducing agent.

13 Claims, 4 Drawing Sheets

PROCESS FOR REDUCING SULFUR AND VAT DYES

Figure 1:
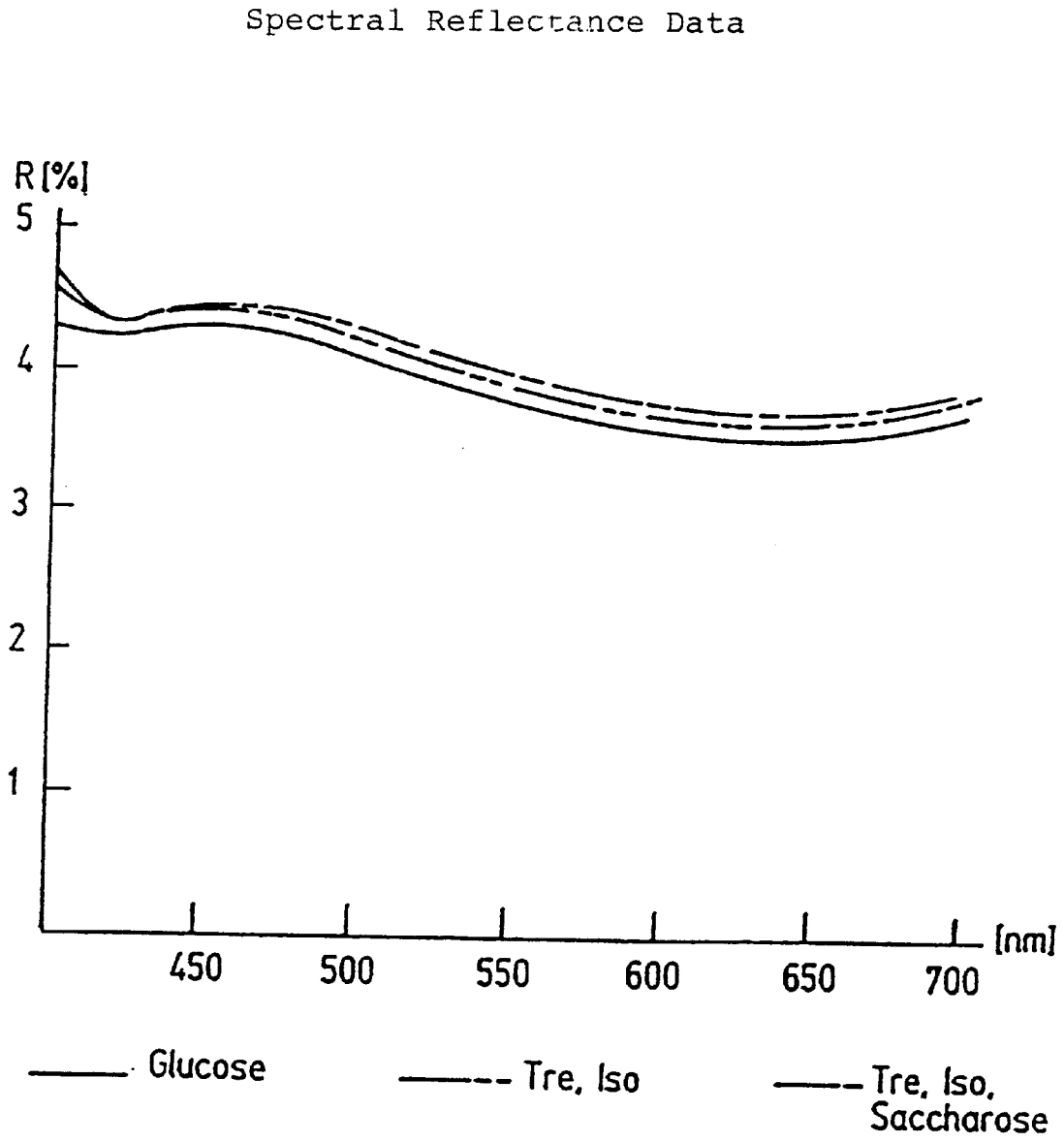

The invention relates to a process for reducing dyestuffs of the group consisting of sulfur dyestuffs and vat dyestuffs.

Processes for dyeing cellulose-containing textile materials with sulfur dyes and vat dyes have been known. Both vat dyestuffs and sulfur dyestuffs must be converted by reduction before, or during, the dyeing process from their water-insoluble form into a water-soluble form having affinity to the fiber, the so-called leuco form. It has been known to use sodium dithionite or sodium sulfide as reducing agent for this purpose. However, they have the disadvantage that a so-called overreduction occurs particularly with delicate dyestuffs, and this implies that, after reduction and application to the textile material, the dyestuffs no longer can be re-oxidised into the desired pigment. Furthermore, the sulfide ions released affect the environment detrimentally by noxious odours and their toxicity. It has been known from DE 41 15 452 A1 to reduce vat dyestuffs by means of fructose, mannose or glucose. It has been known from EP 0 699 797 A2 to reduce sulfur dyestuffs by means of fructose, galactose, glucose, mannose, maltose or lactose. The reduction of the dyestuffs described in these publications by means of reducing sugars has the advantage that the detrimental environmental effects, which result from the release of sulfide ions, are avoided. In view of the low redox potential, for example, of glucose, the same is capable of reducing most of the dyestuffs employed while the risk of overreduction is avoided at the same time. However, it turns out to be a disadvantage that the equilibrium of the redox potential is reached comparatively slowly. Because of the disadvantageous kinetics of the reduction described, the dyeing processes carried out with the aid of the aforementioned sugars require a comparatively long time for reducing the dyestuffs employed.

The industrial problem underlying the present invention aims at making available a process for reducing vat dyestuffs and sulfur dyestuffs, in which the above-mentioned disadvantages are overcome, which is, in particular, ecologically unobjectionable, is capable of reducing a wide gamut of conventional dyestuffs, avoids the risk of overreduction, and has an improved reduction kinetics.

The industrial problem underlying the present invention is solved with the process according to the main claim. Accordingly, the invention involves a process for reducing dyestuffs of the group composed o sulfur dyestuffs and vat dyestuffs, wherein the reduction is carried out in an aqueous alkaline medium with a reducing agent containing isomaltulose or its mixture with other reducing sugars, particularly trehalulose. The use of isomaltulose, particularly of an isomaltulose mixture containing also trehalulose, as the reducing agent in the reduction of sulfur dyestuffs and vat dyestuffs from the water-insoluble form to the water-soluble leuco form has the advantage that the redox potential equilibrium of isomaltulose, particularly of mixtures containing this sugar, is reached considerably more rapidly than with the conventionally used sugars. The fact that the redox potential equilibrium is reached earlier allows an advantageous shortening of the time of the reduction phase when textile materials are dyed, and this, in turn, results in savings. The reducing agent used in accordance with the invention is ecologically unobjectionable, has a lower redox potential so that practically all commercial dyestuffs can be reduced, and does not cause their overreduction.

In the context of the present invention, sulfur dyestuffse are defined as dyestuffs which can be obtained by boiling chemical compounds in polysulfides or in sulfur. In the content of the present invention, vat dyestuffs are defined as dyestuffs which can be considered derivatives of anthraquinone.

The invention teaches to use isomaltulose, and particularly a mixture containing this sugar, as reducing agent. In a particularly preferred manner, the reducing agent contains, in addition to isomaltulose, trehalulose, isomaltose, saccharose, glucose, fructose, or carbohydrate oligomers. More specifically, the invention relates to a reducing agent containing 10 to 90% by weight trehalulose, 10 to 90% by weight isomaltulose, 0 to 15% by weight saccharose, 0 to 20% by weight fructose, 0 to 20% by weight glucose, 0 to 5% by weight carbohydrate oligomers. Isomaltulose-containing reducing agents can be produced in advantageous fashion by converting saccharose enzymatically into isomaltulose and by isolating the isomaltulose so that a product containing non-isolated isomaltulose and trehalulose is obtained. The preparation and composition of a mixture containing isomaltulose and trehalulose has been described in EP 0 625 578 A1 which in regard to the two points cited, is part of the relevant disclosure of the present invention. The inventive reducing agent can contain, in addition to the cited sugars, other reducing agents or auxiliary reducing agents such as, for example, sodium dithionite, buffer systems, complexing agents or the like.

The reduction is conventionally carried out under alkaline conditions in an aqueous solution in which pH values in excess of 11, specifically of 11 to 12.5, are particularly advantageous.

The invention teaches to carry out, in a particularly advantageous fashion, the reduction at at least 50° C., preferably at 80° C. to 100° C.

The invention teaches as an advantageous aspect to provide concentrations of 1 to 50 g/L, preferably of 10 to 30 g/L, of the reducing agent.

The invention also relates to a process for dyeing or imprinting cellulose-containing textile materials with dyestuffs of the group composed of sulfur dyestuffs and vat dyestuffs, wherein the dyestuffs are converted, by following the above-cited inventive process, into the water-soluble leuco form having affinity to the fiber.

In the context of the present invention, cellulose-containing textile materials are defined as materials containing cellulose fibers and, optionally, fibers of other materials, for example, semi-synthetic or fully synthetic materials such as cellulose acetate, polyolefins, polyacrylonitriles, polyesters or polyamides.

The inventive process for dyeing or imprinting cellulose-containing textile materials comprises the aforementioned inventive reduction with the aid of a reducing agent containing isomaltulose or isomaltulose and trehalulose, wherein the dyestuff is applied to the textile material to be dyed before, during, or after the reduction. Following the application and reduction of the dyestuff, the same is re-oxidised and fixed in this way on the textile material, whereby the desired development of the color and the fastness of the dyed textile material are obtained. The oxidation is advantageously carried out by means of oxygen gas or by making use of oxidising salts.

The invention teaches as an advantage to introduce the reducing agent to be used in accordance with the invention under the influence of ultrasound during the dyeing process for reducing the dyestuff to be applied.

The invention is described in detail by way of the figures and the respective embodiments.

Figure 2:
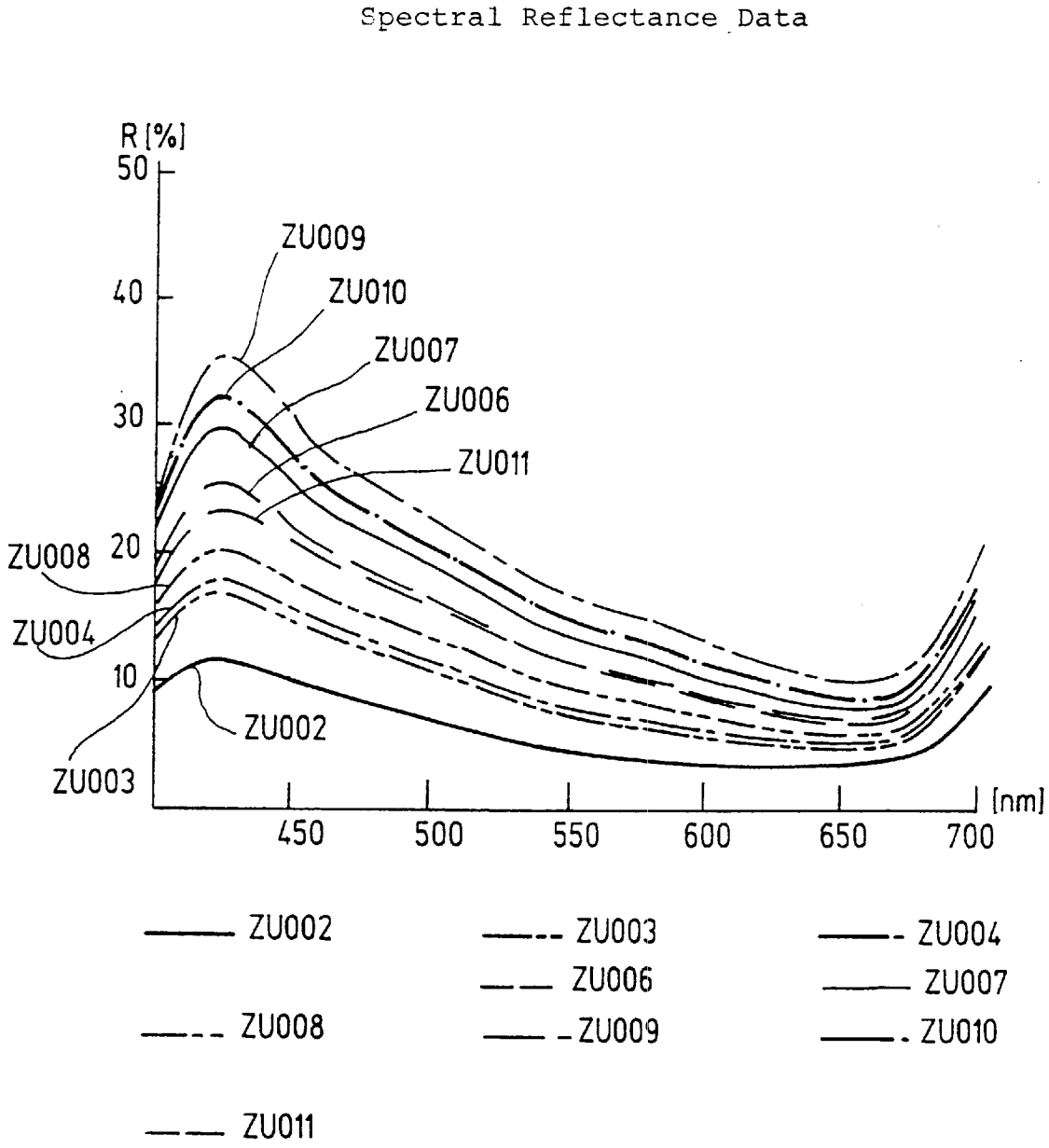
Figure 3:
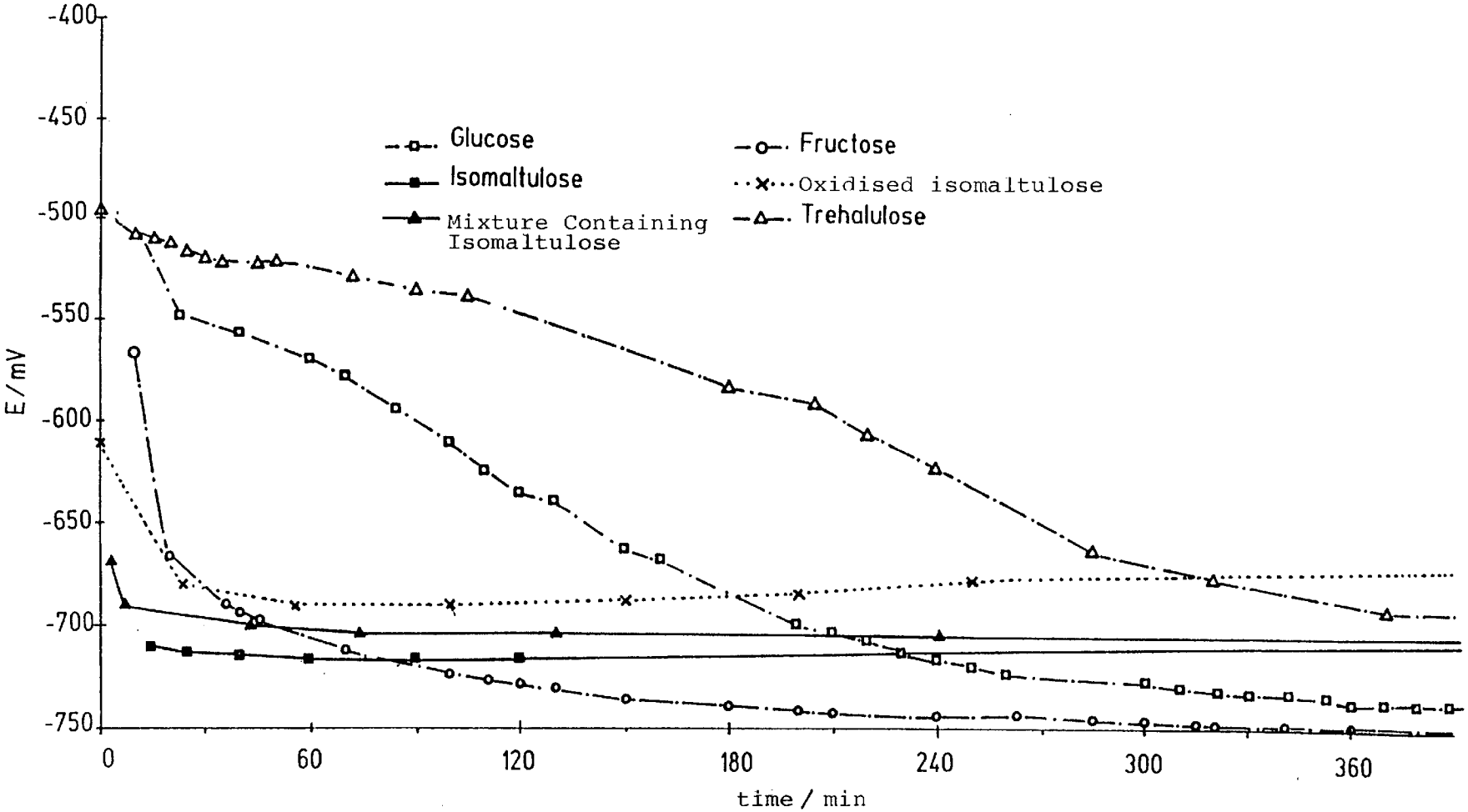
Figure 4:
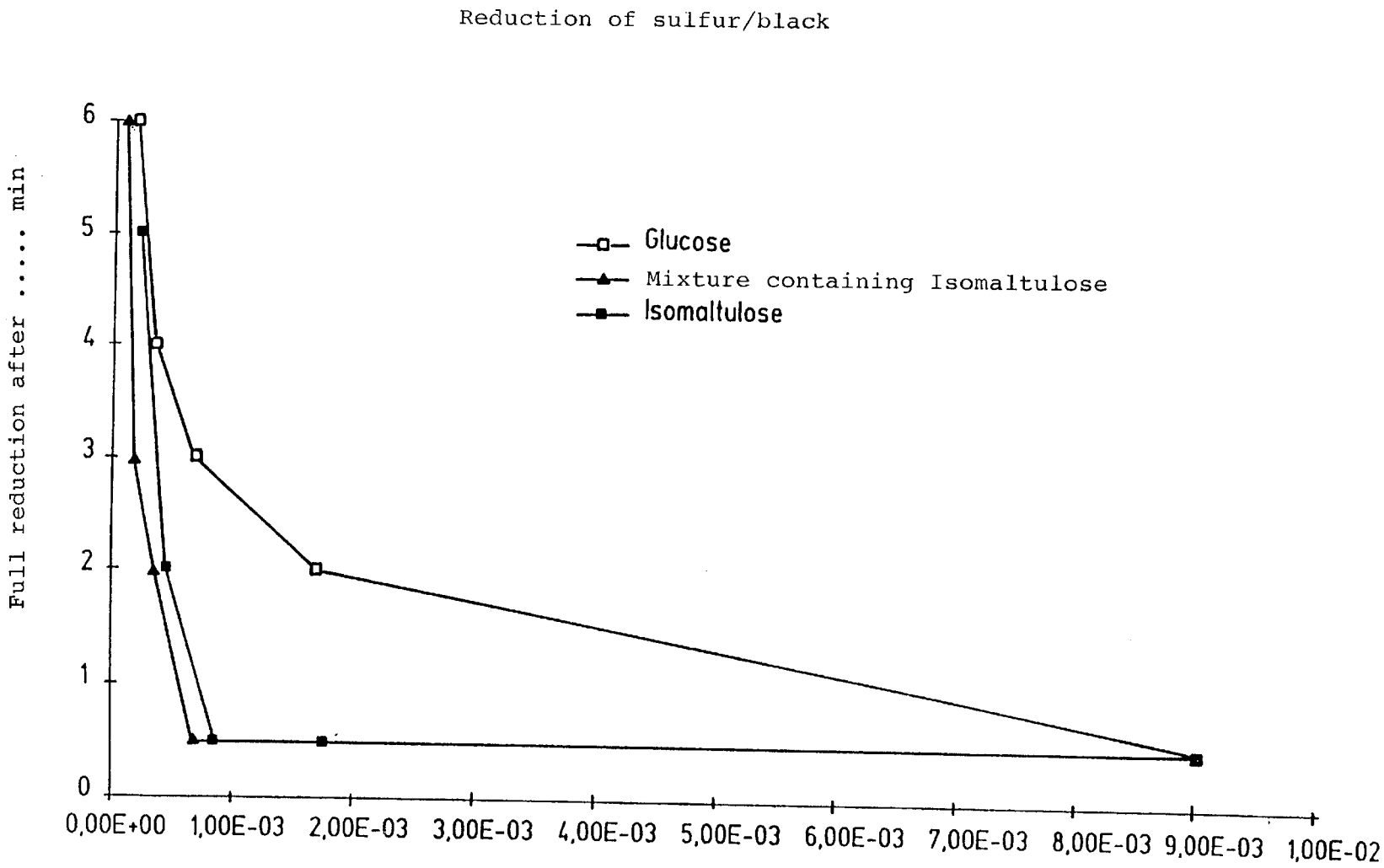

There show:

FIG. 1, a graphical representation of the reflectance data (sulfur dyestuff);

FIG. 2, a graphical representation of the reflectance data (vat dyestuff);

FIG. 3, a graphical representation of the development of the redox potential of various sugar solutions in aqueous alkaline medium; and FIG. 4, a graphical representation of the reduction kinetics of a mixture of sugars comprising isomaltulose, trehalulose, and other sugars such as glucose, and isomaltulose and glucose.

EXAMPLE 1

Dyeing of Textile Material by Means of Sulfur Dyestuff

Batiste (washed and boiled in alkali) of cotton was dyed with 10% liquid Immedialschwarz CBR in the laboratory dyeing apparatus Turbomat of the company Ahiba. During its application to the textile material, the dyestuff was reduced to the water-soluble form by means of a reducing agent. The way in which the process was carried out corresponded to the usually employed technology (highly alkaline, starting from 40° C. and heated to 100° C., the reaction at 100° C. lasts one hour). The liquor ratio was 1:10.

An aqueous glucose solution (10 g/L) was used as the reducing agent in a comparative test.

Test 1 (trehalulose, isomaltulose) was made with a reducing agent of the following composition: 17.5% by weight fructose, 14.9% by weight glucose, 19.5% by weight isomaltulose, 41.5% by weight trehalulose, 3.1% by weight isomaltose, 3.2% by weight higher oligomers (including reversible products), 0.3% by weight unidentified residual substances (referred to the dry substance) (concentration of the reducing agent 14 g/L of aqueous solution).

Test 2 (trehalulose, isomaltulose, saccharose) was made with a reducing agent having the following composition: 12.3% by weight fructose, 9.7% by weight glucose, 10.4% by weight saccharose, 19.5% by weight isomaltulose, 41.5% by weight trehalulose, 3.1% by weight isomaltose, 3.2% by weight higher oligomers (including reversible products), 0.3% by weight unidentified residual substances (referred to the dry substance) (concentration of the reducing agent: 14 g/L of aqueous solution). The reducing agent used in Test 1 can be obtained from the above reducing agent by hydrolysis.

Results:

A. Color gradation measurements (according to CIE Lab) made on the dyed textile substrate:

TABLE 1

| Test 1 | | | | | | |
|---|---|---|---|---|---|---|
| Sample | glucose comparison vs. Test 1 | | | | | |
| type of light | DC | DH | DE | DL | Da | Db |
| D 65 | −0.0 | −0.0 | 0.4 | 0.4 | −0.0 | 0.0 |
| A | −0.0 | −0.0 | 0.4 | 0.4 | −0.0 | 0.0 |
| TL84 | −0.0 | −0.0 | 0.4 | 0.4 | −0.0 | 0.1 |

TABLE 2

| Test 2 | | | | | | |
|---|---|---|---|---|---|---|
| Sample | glucose comparison vs. Test 2 | | | | | |
| type of light | DC | DH | DE | DL | Da | Db |
| D 65 | −0.3 | −0.2 | 0.8 | 0.7 | −0.1 | 0.3 |
| A | −0.3 | −0.02 | 0.8 | 0.7 | −0.0 | 0.3 |
| TL84 | −0.4 | −0.2 | 0.8 | 0.7 | −0.1 | 0.4 |

Table 1 and Table 2 present the results of the color gradation measurements made in accordance with DIN 5033/part 1 and DIN 6174. The notation is interpreted as follows: DC denotes the difference of purity or brightness of color; DH, the difference in hue; DE, the total color gradation (a visual gradation is noted at DE>2); DL, the brightness difference; Da, the color difference on the red-green axis; and Db, the color difference on the yellow blue axis. It can be inferred from Tables 1 and 2 that the DE value is less than 2 in both the color gradation measurements of Test 1/glucose comparison and in Test2/glucose comparison so that a color gradation of the dyed textiles cannot be recognised visually.

B. Color reflectance:

Measurements of color reflectance on the textile material rendered the data shown in FIG. 1 (Iso denotes isomaltulose; Tre, trehalulose). The dependence of the color reflectance data determined with the inventive reduction process approximately agrees with that of the comparative process but slightly higher reflectance values were observed.

C. Color fastness:

Table 3 presents data obtained in the determination of laundering fastness, fastness to perspiration, and fastness to rubbing.

1.) Determination of laundering fastness (60° C.) according to DIN EN 20105, part CO3;

2.) determination of laundering fastness (95° C.) according to DIN EN 20105, part CO5;

3.) determination of fastness to perspiration according to DIN 54020;

4.) determination of fastness to rubbing according to DIN EN ISO 105-X 12.

Textile material: batiste 100 CO (cotton) colour: black.

TABLE 3

| Color fastness | | | |
|---|---|---|---|
| | glucose comparison | Test 1 | Test 2 |
| 1. Laundering fastness 60° C.: | | | |
| mark for staining | 5 | 5 | 5 |
| mark for change in hue | 3H | 3–4H | 3H |
| 2. Laundering fastness 95° C.: | | | |
| mark for staining | 5 | 4–5 | 4–5 |
| mark for change in hue | 3H | 3H | 3H |
| 3. Fastness to perspiration, alkaline: | | | |
| mark for staining | 5 | 5 | 5 |
| mark for change in hue | 4H | 4H | 3H |
| acid: mark for staining | 5 | 5 | 5 |
| mark for change in hue | 3–H | 3–H | 3H |
| 4. Fastness to rubbing: | | | |
| mark when dry | 4–5 | 3–4 | 4 |
| mark when wet | 2–3 | 2–3 | 3 |

H means brighter

Table 3 shows clearly that the color fastness data obtained with the reducing agent used in accordance with the invention correspond to the color fastness data obtained with glucose.

D. Determination of translucency color data of the dyeing liquor after termination of the dyeing process

TABLE 4

| | Translucency color data | | |
|---|---|---|---|
| | 436 nm | 525 nm | 620 nm |
| Glucose for comparison | 1620 | 1190 | 1250 |
| Test 1 | 1750 | 1330 | 1400 |
| Test 2 | 1620 | 1160 | 1210 |

Table 4 lists the data which were obtained in the determination of the translucency color values of the dye liquor after termination of the dyeing process. Also in this case, the data determined with the inventive process correspond to those of the comparative process.

EXAMPLE 2

Dyeing of Textile Materials by Means of Vat Dyestuffs

Material used:

Textile material:

100% CO fabric (cotton, grey, prepared for dyeing)

sample weight:

8.5 g dyestuff:

pure indigo (DASF)

amount of dye used:

1 g/L auxiliary agents:

5 mL/L NaOH 3 g/L sodium dithionite (reducing agent)

initial vat liquor:

80 mL steeping water 4 g of pure indigo (BASF)

5 mL NaOH 3 g/L sodium dithionite make full 100 mL with steeping water.

Execution of process:

The indigo powder is suspended in 50 mL of water. First the sodium hydroxide, then the sodium dithionite as reducing agent are added to 30 mL of water. Both the dyestuff and the initial solution of the auxiliary agents are heated to 50° C. and transferred into a beaker (volume 200 mL). This mixture is augmented to 100 mL and vatted for 30 min at 50° C.

Dyeing vat:

800 mL water were heated to 50° C. in a beaker (beaker volume 1500 mL), a pretreatment with sodium hydroxide and sodium dithionite was carried out, the stock vat was added, and then the solution was filled up to make 1000 mL. Dyeing was carried out in two dips of 10 min each.

A. Dyeing without reducing agent:

The dyeing was carried out as described above, but no reducing agent was employed. This test served as a benchmark test.

It was observed that the liquor maintained its dark blue color. When the textile material was immersed in the dye liquor, dye absorption could not be observed. Only slight smudging of the textile material was noticed.

B. Dyeing with sodium dithionite as the reducing agent:

The dyeing was carried out as described above, but sodium dithionite was employed as the reducing agent. This test served as a comparison with the inventive process.

It was observed that the dye liquor has a yellowish color after 15 min vatting and the surface, a slight metallic blue color. The immersed textile material had dark blue color after airing.

C. Dyeing with the reducing agent according to the invention, containing isomaltulose and trehalulose (test 1):

Dyeing was carried out with the above-described process. A reducing agent consisting of 17.5% by weight fructose, 14.9% by weight glucose, 19.5% by weight isomaltulose, 41.5% by weight trehalulose, 3.1% by weight isomaltose, 3.2% by weight higher oligomers (including reversible products), and 0.3% by weight unidentified residual substances (referred to the dry substance) was used in place of sodium dithionite. The reducing agent was used in concentrations of 10 g/L, 20 g/L and 30 g/L.

It was observed that the dye liquor assumed a blue-green color after addition of the reducing agent which was used in accordance with the invention and after the subsequent vatting. After airing, the immersed textile materials had blue color which, however, is significantly brighter than that obtained with the sodium dithionite vat. The depth of the color decreased with increasing amounts of the reducing agent used.

D. Dyeing with the reducing agent according to the invention, containing isomaltulose, trehalulose, and saccharose (test 2);

The test conditions corresponded to the above-described test conditions. A reducing agent consisting of 12.3% by weight fructose, 9.7% by weight glucose, 10.4% by weight saccharose, 19.5% by weight isomaltulose, 41.5% by weight trehalulose, 3.1% by weight isomaltose, 3.2% by weight higher oligomers (including reversible products), and 0.3% by weight unidentified residual substances was used in place of sodium dithionite. The reducing agent was used in concentrations of 10 g/L, 20 g/L and 30 g/L.

It was observed that the dye liquor assumed a blue-green color after addition of the reducing agent which was used in accordance with the invention and after the subsequent vatting. After airing, the immersed textile materials had blue color which, however, is significantly brighter than that obtained with the sodium dithionite vat. The depth of color decreased with increasing amounts of the reducing agent used.

E. Dyeing under the influence of ultrasound, with the reducing agent according to the invention containing trehalulose, isomaltulose, and saccharose.

The test conditions and the test solutions corresponded to those described under D). In addition, ultrasound was applied. It was observed that the dye liquor assumed a blue-green color after the addition of the inventive reducing agent and subsequent vatting. The immersed textiles had a blue color which was significantly darker than in the case of dyeing without the application of ultrasound. The depth of the color decreased with increasing amounts of the reducing agent.

The following table lists the test solutions:

TABLE 5

| | test solutions | | |
|---|---|---|---|
| No. | test code | reducing agent | amount used [g] |
| 1 | ZU001 | without | — |
| 2 | ZU002 | sodium dithionite | 3 |
| 3 | ZU003 | isomaltulose, trehalulose, saccharose | 10 |
| 4 | ZU004 | isomaltulose, trehalulose | 10 |
| 5 | ZU005 | isomaltulose, trehalulose, saccharose (with ultrasound) | 10 |
| 6 | ZU006 | isomaltulose, trehalulose, saccharose | 20 |
| 7 | ZU007 | isomaltulose, trehalulose | 20 |
| 8 | ZU008 | isomaltulose, trehalulose, saccharose (with ultrasound) | 20 |

TABLE 5-continued

| No. | test code | test solutions: reducing agent | amount used [g] |
|---|---|---|---|
| 9 | ZU009 | isomaltulose, trehalulose, saccharose | 20 |
| 10 | ZU010 | isomaltulose, trehalulose | 20 |
| 11 | ZU011 | isomaltulose, trehalulose, saccharose (with ultrasound) | 30 |

The tests which are listed in Table 5 and which were characterised by test codes rendered the results shown in FIG. 2.

The reflectance data, which were obtained with the process according to the invention, exceeded those obtained with sodium dithionite.

Fastness testing:

Fastness testing attests to the resistance of a dyed material against influences during textile production (production useability) and during the use of the textile (wear useability).

TABLE 6

| No. | fastness testing: rubbing fastness: mark when dry | rubbing fastness: mark when wet | laundering fastness: mark for staining | laundering fastness: mark for change of hue |
|---|---|---|---|---|
| 2 | 3–4 | 2 | 4–5 | 3–4H |
| 3 | 4 | 2–3 | 4–5 | 3H |
| 4 | 4 | 2 | 4–5 | 3H |
| 5 | 4 | 2 | 4–5 | 3–4H |
| 6 | 4 | 2–3 | 5 | 3–4H |
| 7 | 4 | 2–3 | 5 | 3H |
| 8 | 4 | 2–3 | 5 | 3H |
| 9 | 4–5 | 3 | 5 | 3H |
| 10 | 4 | 2–3 | 5 | 3H |
| 11 | 4 | 2–3 | 5 | 2–3H |

H means brighter

Fastness to rubbing, as well as laundering fastness, of the reducing agents used in accordance with the invention must be graded "good" and considered to be comparable to those obtained with sodium dithionite.

EXAMPLE 3

Development of the Redox Potential E

Example 3 shows that the redox potential equilibrium is reached faster with isomaltulose and isomaltulose-containing mixtures than with other sugars, such as glucose.

At pH 12.2 (KOH strength 25%) and at a temperature of 20° C., the adjustment to the equilibrium of the redox potential E was studied in each case with 1.5 molar solutions vis-a-vis Ag/AgCl/KCl (3M, E*=210 mV vs SHE, 20° C.). The 1.5 molar solutions studied contained a) isomaltulose and b) a sugar mixture comprising isomaltulose (isomaltulose, fructose, glucose, trehalulose, isomaltose). The substances used for comparison were c) glucose, d) fructose, e) oxidised isomaltulose, and f) trehalulose It can be inferred from FIG. 3 that the redox potential equilibrium is reached already after a few minutes in the case of isomaltulose and isomaltulose-containing mixtures, whereas it takes considerably more time, namely several hours, to reach the redox potential equilibrium with the comparative substances. Vis-a-vis the comparative substances, oxidised isomaltulose exhibits an increased rate at establishing the redox potential equilibrium.

EXAMPLE 4

Reduction of Sulfur/Black

This example shows that isomaltulose or isomaltulose-containing mixtures (isomaltulose, trehalulose, glucose, fructose, isomaltose) can reduce sulfur dyestuffs significantly more rapidly than the comparative substance glucose.

FIG. 4 shows the time span within which full reduction of the dyestuff is obtained as a function of the ratio of reducing carbonyl groups of the reducing agent to the amount of dyestuff.

FIG. 4 shown that complete reduction of pretreated Diresul Liquid Black RDT (Clariant) occurs at 50° C. with isomaltulose or isomaltulose-containing mixtures much more rapidly than with glucose as the reducing agent. The originally soluble dyestuff Diresul Liquid Black RDT was converted into the absolutely sulfide-free and, hence, insoluble form, prior to the test work. The dyestuff used for the tests is at 50° C. completely insoluble in a highly alkaline aqueous solution which is free of reducing agents.

FIGS. 3 and 4 therefore shown that the reducing agent used in accordance with the invention facilitates a much faster establishment of the redox potential equilibrium and, hence, that a shortened reduction of the dyestuffs is obtained.

What is claimed is:

1. A process for reducing dyestuffs of the group consisting of sulfur dyestuffs and vat dyestuffs, wherein the reduction is carried out in an alkaline medium with isomaltulose or an isomaltulose-containing mixture as the reducing agent.

2. The process according to claim 1, characterised in that the reducing agent contains in addition, trehalulose, isomaltose, saccharose, glucose, fructose or carbohydrate oligomers.

3. The process according to claim 1, characterised in that the reducing agent contains 10 to 90% by weight trehalulose, 10 to 90% by weight isomaltulose, 0 to 15% by weight saccharose, 0 to 20% by weight fructose, 0 to 20% by weight glucose, 0 to 5% by weight isomaltose, and 0 to 5% by weight carbohydrate oligomers (referred to the dry substance).

4. The process according to claim 1, characterised in that the reducing agent contains 42% by weight trehalulose, 20% by weight isomaltulose, 10% by weight saccharose, 12% by weight fructose, 10% by weight glucose, 3% by weight isomaltose, and 3% by weight oligomers (referred to the dry substance).

5. The process according to claim 1, characterised in that the reducing agent contains 42% by weight trehalulose, 20% by weight isomaltulose, 17% by weight fructose, 15% by weight glucose, 3% by weight isomaltose, and 3% by weight carbohydrate oligomers (referred to the dry substance).

6. The process according to claim 1, characterised in that the aqueous alkaline medium has a pH>11.

7. The process according to claim 1, characterised in that the reduction is carried out at at least 50° C.

8. The process according to claim 1, characterised in that the reduction is carried out under the influence of ultrasound.

9. A process for dyeing or imprinting cellulose-containing textile materials with dyestuffs of the group composed of sulfur dyestuffs or vat dyestuffs, wherein the initially water-insoluble dyestuff is applied to the textile material and the dyestuff is reduced with a process according to claim 1 and oxidised thereafter.

10. A process for dyeing or imprinting cellulose-containing textile materials with dyestuffs of the group composed of sulfur dyestuffs or vat dyestuffs, wherein the initially water-insoluble dyestuff is reduced with a process according to claim 1, then applied to the material, and oxidised thereafter.

11. A process for dyeing or imprinting cellulose-containing textile materials with dyestuffs of the group composed of sulfur dyestuffs or vat dyestuffs, wherein the initially water-insoluble dyestuff is reduced according to claim 1 and simultaneously applied to the material and oxidised thereafter.

12. The process according to claim 9, characterised in that the dyeing or imprinting is carried out under the influence of ultrasound.

13. The process according to claim 1 characterized in that the reduction is carried out at 80° C. to 100° C.

* * * * *

UNITED STATES PATENT AND TRADEMARK OFFICE

CERTIFICATE OF CORRECTION

PATENT NO. : 6,093,221

DATED : July 25, 2000

INVENTOR(S) : Grüll et al.

It is certified that error appears in the above-identified patent and that said Letters Patent is hereby corrected as shown below:

ON THE TITLE PAGE

Item

[86] PCT/EP97/06544

§ 371 Date: July 22, 1999

§ 102(e) Date: July 22, 1999

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,093,221
DATED : July 25, 2000
INVENTOR(S) : Grull et al.

It is certified that error appears in the above-identified patent and that said Letters Patent is hereby corrected as shown below:

Title page,
Item [30], should read:
-- [30] Foreign Application Priority Data
Dec. 7, 1996 [DE] Germany 196 50 825 --

Signed and Sealed this

Eighteenth Day of May, 2004

JON W. DUDAS
*Acting Director of the United States Patent and Trademark Office*